US007770403B2

(12) United States Patent
Kojima et al.

(10) Patent No.: US 7,770,403 B2
(45) **Date of Patent: *Aug. 10, 2010**

(54) INDOOR AND OUTDOOR UNIT COMMUNICATION VIA SIGNAL FROM A POWER LINE

(75) Inventors: Yasuyuki Kojima, Hitachi (JP); Noboru Akiyama, Hitachinaka (JP); Takeshi Onaka, Hitachi (JP); Tatsumi Yamauchi, Hitachiota (JP); Koichi Taniguchi, Yokohama (JP); Koichi Tokushige, Shizuoka (JP); Noriyuki Bunkou, Shizuoka (JP); Keiji Sato, Fujikawa (JP)

(73) Assignee: Hitachi Appliances, Inc., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/368,681

(22) Filed: Feb. 10, 2009

(65) Prior Publication Data

US 2009/0145147 A1 Jun. 11, 2009

Related U.S. Application Data

(63) Continuation of application No. 10/823,780, filed on Apr. 14, 2004, now Pat. No. 7,523,619.

(30) Foreign Application Priority Data

Apr. 15, 2003 (JP) ..... 2003-109709

(51) Int. Cl.
*F25B 49/00* (2006.01)
*G05D 23/00* (2006.01)
*G01M 1/38* (2006.01)

(52) U.S. Cl. ..... 62/132; 236/51; 700/276

(58) Field of Classification Search ..... 62/127, 62/132, 175, 231, 912, 914; 236/1 C, 51; 700/276

See application file for complete search history.

(56) References Cited

U.S. PATENT DOCUMENTS 4,843,833 A 7/1989 Polkinghorne (Continued)

FOREIGN PATENT DOCUMENTS

JP A-02-281821 4/1989

(Continued)

OTHER PUBLICATIONS

John E. Hosford, Optimal Allocation of Leased Communication Lines, 1963, Management Science, vol. 9, No. 4, pp. 613-622.

*Primary Examiner*—Marc E Norman
(74) *Attorney, Agent, or Firm*—Crowell & Moring LLP

(57) ABSTRACT

An air conditioning system is arranged to use a power line for communication. The air conditioning system includes one or more indoor units, one or more outdoor units, and a system controller for controlling the indoor units or outdoor units and executes communications between the indoor units and the outdoor units as overlapping a signal on the power line for supplying electric power. The outdoor units are connected with the system controller through a leased communication line. The indoor unit provides a power line communication device being connected with the power line. The outdoor unit provides a leased communication device being connected with the leased communication line. A bridge is also provided for connecting the leased communication line and the power line. The control information is exchanged mutually between the indoor units, the outdoor units and the system controller through the power line.

10 Claims, 11 Drawing Sheets

U.S. PATENT DOCUMENTS 6,430,953 B2 8/2002 Roh
6,453,689 B2 9/2002 Wada
6,622,924 B2 9/2003 Arata et al.
7,523,619 B2 * 4/2009 Kojima et al. ..... 62/132
2003/0140637 A1 7/2003 Masui et al.

FOREIGN PATENT DOCUMENTS

JP A-2002-243248 2/2001

* cited by examiner

INDOOR AND OUTDOOR UNIT COMMUNICATION VIA SIGNAL FROM A POWER LINE

This application is a continuation of U.S. application Ser. No. 10/823,780, filed Apr. 14, 2004 which claims priority to JP 2003-109709, filed Apr. 15, 2003, the contents of each of which are incorporated by reference herein in their entirety.

BACKGROUND OF THE INVENTION

The present invention relates to a control system arranged to overlap a high-frequency signal on a power line when performing communications on a power line.

The conventional air conditioning system is composed to have one or more outdoor units, one or more indoor units, a three-phase and a single-phase power lines for supplying electric power to these units, a refrigerant piping for exchanging refrigerant between the indoor units and the outdoor units, a bus wiring transmission line for exchanging control information between the indoor units and the outdoor units, and a remote controller for operating the indoor units. The control information of the air conditioning system includes an indication of on or off of a power supply or "in operation" of the indoor unit, a set room temperature and a current temperature, operating conditions of the outdoor unit and the indoor unit, and so forth. These pieces of data also include a header composed of address information of a transmission source and a receiving destination, a type, a size and a number of a message as well as a trailer such as error-correcting information, all of which are added to the data. The resulting data is communicated in the form of packets. In the conventional air conditioning system, a leased communication line has been provided as its communicating method. Today, it is known that a technology of using the power line for the leased communication line has been developed for saving resources and installing work.

As an electric power communication system of transmitting the high-frequency signal via the power line, the following lighting system has been proposed. A plurality of branch power lines are secured as communication regions by separating them with a blocking filter. A gate way is located to and connected with each of these communication areas and a high-speed communication line is connected between the gate ways so that the control information may be exchanged between the outside and the inside of the communication region. See the Japanese Official Gazette of JP-A-02-281821 which shows the load controlling (PLC) in the lighting system. This document does not concern the air conditioning system wherein communications are concentrated. As a power line of the lighting system, a high-speed leased communication line is used because the communication capacity required for communicating data between the gateways in the communication based on the power line (referred to as the power line communication) is not enough. In the air conditioning system, however, the communication capacity of the system is determined not from the communications traffic between the similar communication regions but from the communications traffic between the indoor unit and the outdoor unit. Hence, the power line of the lighting system does not hold true to the air conditioning system as it is. Further, the power line communication to a large-scaled air conditioning system and the communications between different phases are disclosed as well. This technology is arranged to connect a power line communication area of an outdoor unit having a three-phase power line as a communication path and a power line communication area of an indoor unit having a single-phase power line as a communication path through a bridge in a wireless or a wired manner with the leased communication path. (See the Official Gazette of JP-A-2002-243248.)

SUMMARY OF THE INVENTION

The work of installing the air conditioning system includes a work of wiring a power line, a refrigerant piping work, and a work of installing an air conditioning machine. The topology of the wiring and piping is different in each work, so that the renewal work is so complicated. The air conditioning system arranged to use the power line as transmission means is restrictive in its transmission rate and topology. This leads to a disadvantage of lowering the response and making the overall system more costly because of a special connecting means to be required therefor.

It is an object of the present invention to provide an air conditioning system arranged to use a power line as communication means which saves resources and installing work.

In carrying out the object of the invention, according to an aspect of the invention, the air conditioning system having an indoor unit, an outdoor unit, and a central controller for controlling the indoor unit or the outdoor unit and arranged to establish communication between the indoor unit and the outdoor unit with a signal transmitted through a power line supplying an electric power, comprises:

a leased communication line for connecting the outdoor unit with the system controller;

power line communication means provided in the indoor unit and being connected with the power line;

leased communication means provided in the outdoor unit and being connected with the leased communication line; and a bridge for connecting the leased communication line with the power line; and wherein control information is exchanged between the indoor unit and the outdoor unit.

Other objects, features and advantages of the invention will become apparent from the following description of the embodiments of the invention taken in conjunction with the accompanying drawings.

DESCRIPTION OF THE EMBODIMENTS

The first embodiment of the present invention will be described with reference to FIGS. 1 to 7.

Figure 1:
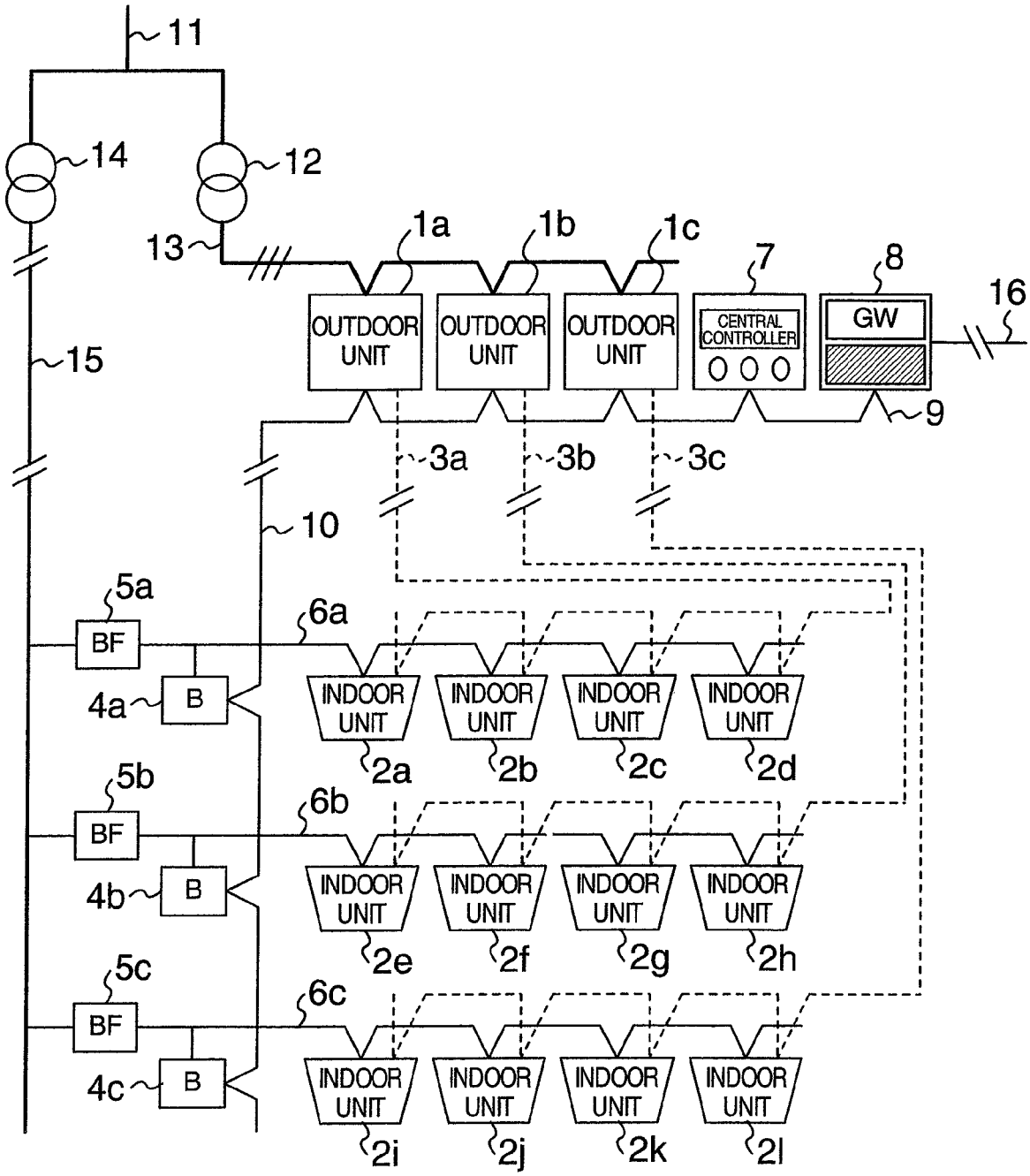
FIG. 1 is a schematic diagram showing an air conditioning system according to an embodiment of the present invention.

FIG. 1 is a schematic diagram showing an overall arrangement of an air conditioning system arranged to use a power line as a communication means according to the first embodiment of the present invention.

In FIG. 1, reference numbers 1*a* to 1*b* denote outdoor units, reference numbers 2*a* to 2*l* denote indoor units, reference numbers 3*a* to 3*c* denote refrigerant pipings, reference numbers 4*a* to 4*c* denote bridges, reference numbers 5*a* to 5*c* denote blocking filters, reference numbers 6*a* to 6*c* denote branch power lines, a reference number 7 denotes a central controller, a reference number 8 denotes a gateway, a reference number 9 denotes a transmission line through which data may be transmitted at high speed, a reference number 10 denotes a connecting wire between communication areas, a reference number 11 denotes a power-receiving line, a reference number denotes a three-phase transformer, a reference number denotes a three-phase power line, a reference number 14 denotes a single-phase transformer, a reference number 15 denotes a single-phase power wire, and a reference number 16 denotes a WAN (Wide Area Network) connecting line through which wide area communications are executed.

In this embodiment, the air conditioning system includes a plurality of outdoor units 1*a* to 1*c*, each of which is supplied with electric power through the three-phase power line 13. Further, the outdoor units 1*a*, 1*b* and 1*c* are operated to supply and recover refrigerant to and from the corresponding indoor units 2*a* to 2*l* through the refrigerant pipings 3*a*, 3*b* and 3*c*. Further, the outdoor units 1*a* to 1*c* are connected with the central controller 7 and the gateway 8 through the transmission line 9 so that all of them may compose a high-speed communication area. Moreover, these outdoor units are installed to form one or more installing areas such as a rooftop of a building or a underground outside of a building, which are remote from the indoor units. In this embodiment, the transmission line 9 and the connecting wire between the transmission areas correspond to a leased communication line.

On the other hand, the indoor units are divided into three groups, that is, a group of 2*a*, 2*b*, 2*c*, 2*d*, another group of 2*e*, 2*f*, 2*g*, 2*h*, and the other group of 2*i*, 2*j*, 2*k*, 2*l* according to the refrigerant systems. These groups are connected with the refrigerant pipings 3*a*, 3*b*, 3*c* and the branch power lines 6*a*, 6*b*, 6*c*, respectively. The indoor unit includes the power line communication device built therein. Physically, hence, these indoor units are not required to directly connect with the transmission line or the wire connecting between the communication areas. The groups of these indoor units are located in the corresponding installing area in the building. These installing areas are remote from each other by several meters.

The three systems of the brunch power lines 6*a*, 6*b*, 6*c* are prepared for the refrigerant pipings 3*a*, 3*b*, 3*c*, respectively. These branch power lines 6*a*, 6*b*, 6*c* are connected with the single-phase power line 15 through the blocking filters 5*a*, 5*b*, 5*c* respectively so that commercial electric power may be supplied to the indoor units. Further, the branch power lines 6*a*, 6*b*, 6*c* are connected with the bridges 4*a*, 4*b*, 4*c*, respectively. Hence, the modulated high-frequency transmission signal, that is, the signal to be communicated on the power line is overlapped with the commercial supply voltage when the commercial supply voltage is applied to the branch power lines 6*a*, 6*b* and 6*c*.

Figure 2:
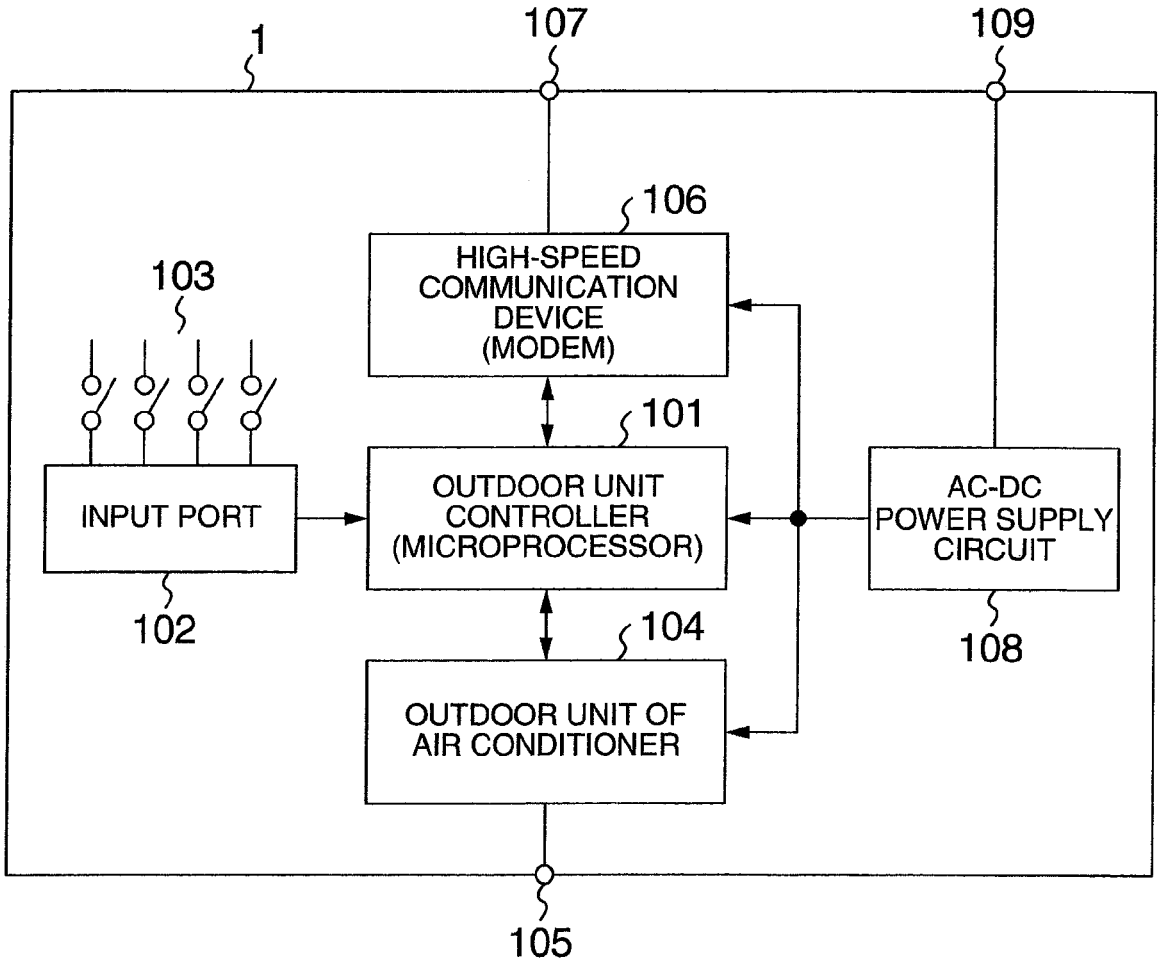
FIG. 2 is a schematic diagram showing an arrangement of an outdoor unit included in the embodiment of the present invention.

FIG. 2 is a schematic diagram showing an internal arrangement of the outdoor unit 1 included in the first embodiment of the present invention. This outdoor unit 1 corresponds to one of the outdoor units 1*a* to 1*c* having been described with reference to FIG. 1. The other outdoor units have the same arrangement as well. The outdoor unit 1 includes an outdoor unit controller 101 as its main component and further an input port 102, a setting switch 103, a high-speed communication device (modem) 106, its transmission path terminal 107, a body of the outdoor unit 104, and an a power supply circuit 108. A reference number 105 denotes a refrigerant piping inlet, which is connected with the indoor unit having the same refrigerant system through the refrigerant piping 3*a* composed of two pipes through which refrigerant is reciprocated. The circulating pump located inside the body of the outdoor unit is served to pressurize the refrigerant so that the refrigerant may be circulated in the piping. The outdoor controller 101 is connected with the corresponding indoor unit. The connection starts from the high-speed communication device (modem) 106, and then passes through a terminal 107, the transmission line 9, the connecting wire 10 between the communication areas, the bridge, and the branch power line, and finally reaches the indoor unit. The outdoor unit is communicated with the indoor unit connected therewith so that the outdoor unit may control the indoor unit as computing the driving conditions of the body of the outdoor unit, that is, the heat exchanger and the compressor based on the operation control information of the indoor unit. The power supply circuit 108 is provided with a power supply terminal 109, which is connected with the three-phase power line 13 through which electric power is supplied to the internal block of the outdoor unit 1*a*. Herein, the operation control information of the indoor unit includes remote controller operation information (on/off state, setting information such as "cooling", "heating", or "ventilation"), room temperature, refrigerant temperature, blow level, power consumption, and so forth.

Figure 3:
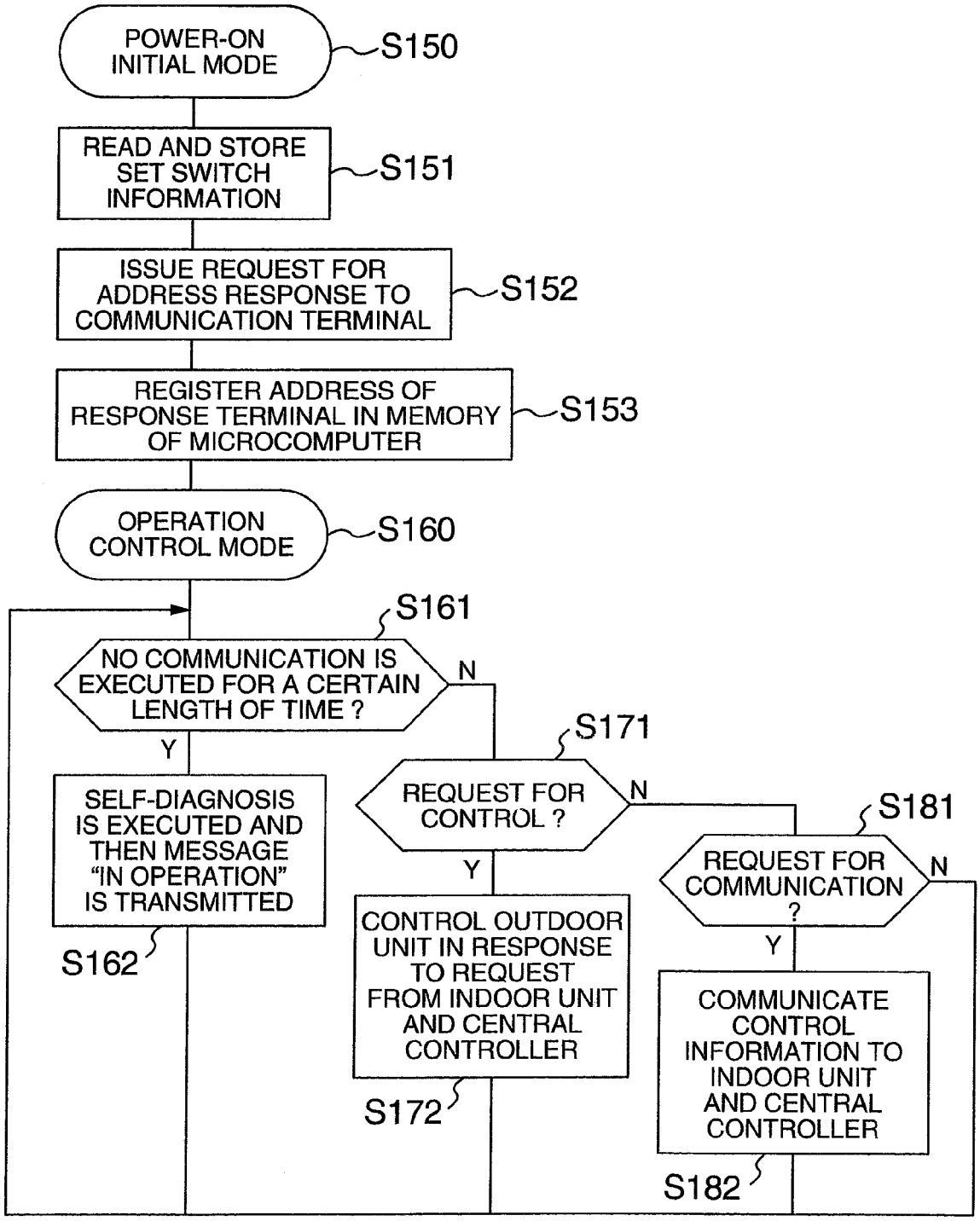
FIG. 3 is a flowchart showing an operation of an outdoor unit included in the embodiment of the present invention.

FIG. 3 is a flowchart showing an operation sequence of the outdoor unit. The outdoor unit has a function of communicating with the indoor unit for which the outdoor unit is responsible, driving and controlling the refrigerant heat exchanger and compressor based on the operation control information of the indoor unit, supplying refrigerant to the indoor unit, and recovering the heat-exchanged refrigerant. At a power-on initial mode (S150), when the power supply is turned on, the outdoor unit controller 101 reads the setting information such as the refrigerant system and its own terminal address through the input port 102 and stores the setting information in the memory located inside the microcomputer (S151). Then, the controller 101 issues a request for a communication terminal address to the indoor unit through the communication terminal, that is, the central controller or the bridge (S152), and then registers an address for the communication terminal in the memory located inside the microcomputer if any response is given back from the indoor unit.

At an operation control mode (S160), the outdoor unit executes three functions. The outdoor unit is communicating with the indoor unit of the same refrigerant system so that the outdoor unit may control the heat exchanger and the fan located inside the body of the outdoor unit based on the operation control information of the indoor unit such as the remote controller operation information, the room temperature, and the refrigerant temperature. When a request for communication is given by the operation and the communication (S181), the information of the outdoor unit is transmitted (S182). If the request for control is given in response (S161), the outdoor unit executes the self-diagnosis over the request, and then the result is reported to the other connecting units through the communication line.

The central controller 7 is a system controlling device for obtaining information of the overall system and controlling the system.

Figure 4:
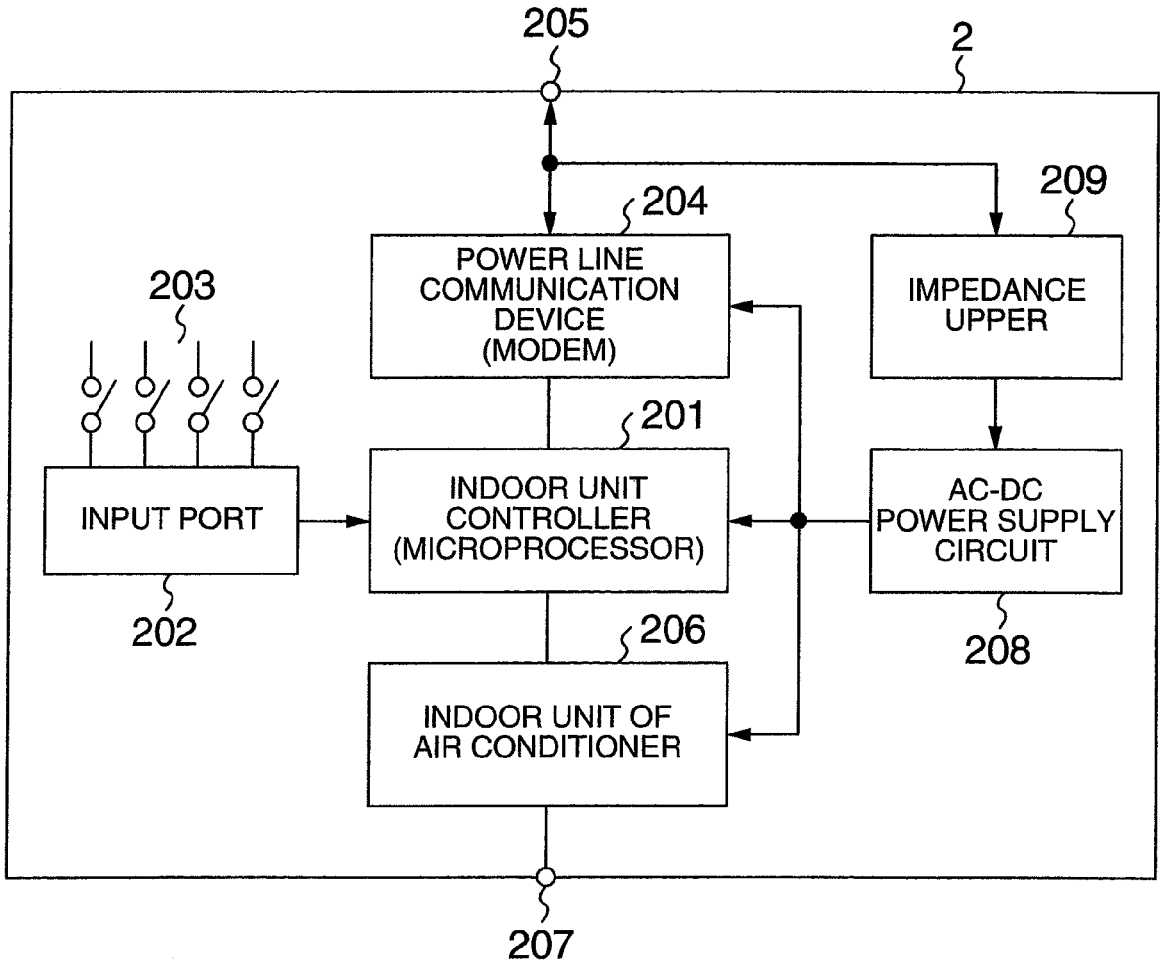
FIG. 4 is a schematic diagram showing an arrangement of an indoor unit included in the embodiment of the present invention.

FIG. 4 is a schematic diagram showing an internal arrangement of the indoor unit 2 included in the first embodiment of the present invention. The indoor unit 2 corresponds to one of the indoor units 2*a* to 1*l* having described with reference to FIG. 1. The other indoor units have the same arrangement. The indoor unit 2 includes an indoor unit controller 201 as its main component and further, an input port 202, a setting switch 203, a power line communication device (modem) 204, its transmission terminal 205, a body of the indoor unit 206, a refrigerant piping inlet 207, a power supply circuit 208, and an impedance upper 209.

The communicating connection of the indoor unit controller 201 is formed as follows. The controller 201 of the indoor unit starts from the power line modem 204, passes through the transmission terminal 205, the branch power line, the bridge, the connecting wire 10 between the communication areas, and the transmission line 9, and then reaches the corresponding outdoor unit. The indoor unit controller 201 computes the driving conditions of the body of the outdoor unit, that is, the refrigerant heat exchanger and the compressor based on the information sent from the outdoor unit such as the refrigerant temperature and the refrigerant pressure, the remote controller operation information, and the room temperature so that the indoor unit controller 201 controls the body of the outdoor unit. The power supply circuit 208 is connected with the branch power line through the impedance upper 209 so that the power supply circuit 208 may supply the internal block of the indoor unit with electric power. The impedance upper 209 is served as a filter of modifying an AC impedance and noises of the power supply 208 into a prescribed value. It may be located if necessary. The impedance upper 209 may be left out depending on the outdoor unit impedance and the performance of the power line modem.

Figure 5:
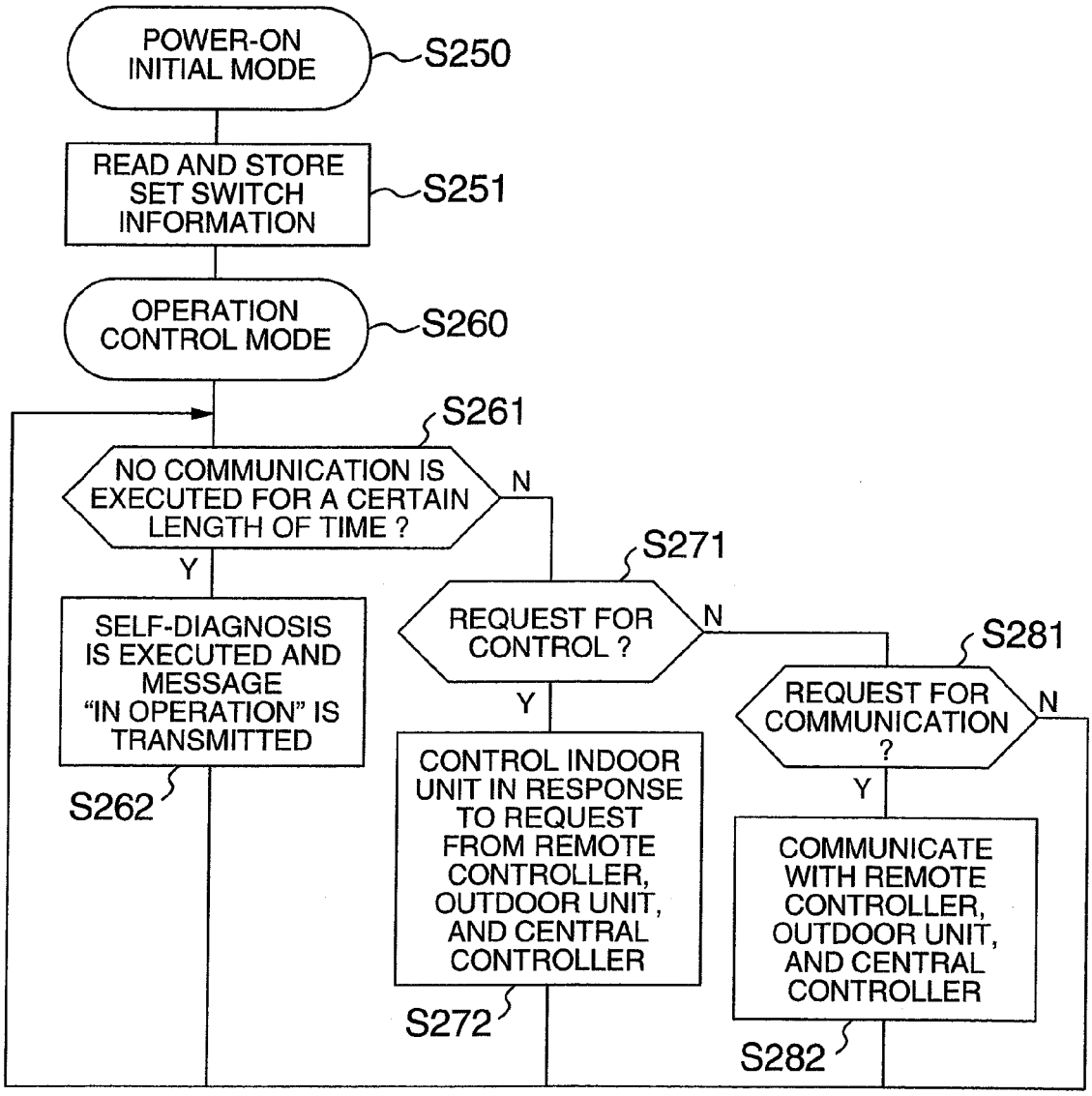
FIG. 5 is a flowchart showing an operation of the indoor unit included in the embodiment of the present invention.

FIG. 5 is a flowchart showing an operation sequence of the indoor unit included in the first embodiment of the present invention. The indoor unit has a function of communicating with the outdoor unit for which the indoor unit is responsible, driving the indoor unit based on the operation control information such as the remote controller operation information and the room temperature so as to switch a cooling or a heating operation and change a room temperature, an air-flow volume, an air direction, and so forth. At a power-on initial mode (S250), if the power supply is turned on, the indoor unit controller 201 operates to read the set information (such as the refrigerant system and its own communication terminal address) of the setting switch 203 through the input port 202 and then stores the information in the memory located inside the microcomputer (S251).

At an operation control mode (S260), the indoor unit is communicating with the outdoor unit belonging to the same refrigerant system so that the indoor unit may control the heat exchanger and the fan located inside the body of the indoor unit and the air direction based on the operation control information (such as the remote controller operation information, the room temperature, and the refrigerant temperature) of the indoor unit. If the request for communication (S281) is given by the operation and the communication, the information of the indoor unit is transmitted (S282). If the request for control (S271) is responded, the indoor unit is controlled (S272). If the communication is terminated for a certain length of time (S261), the indoor unit executes the self-diagnosis and then reports the result to the other connecting units through the communication line (S262).

Figure 6:
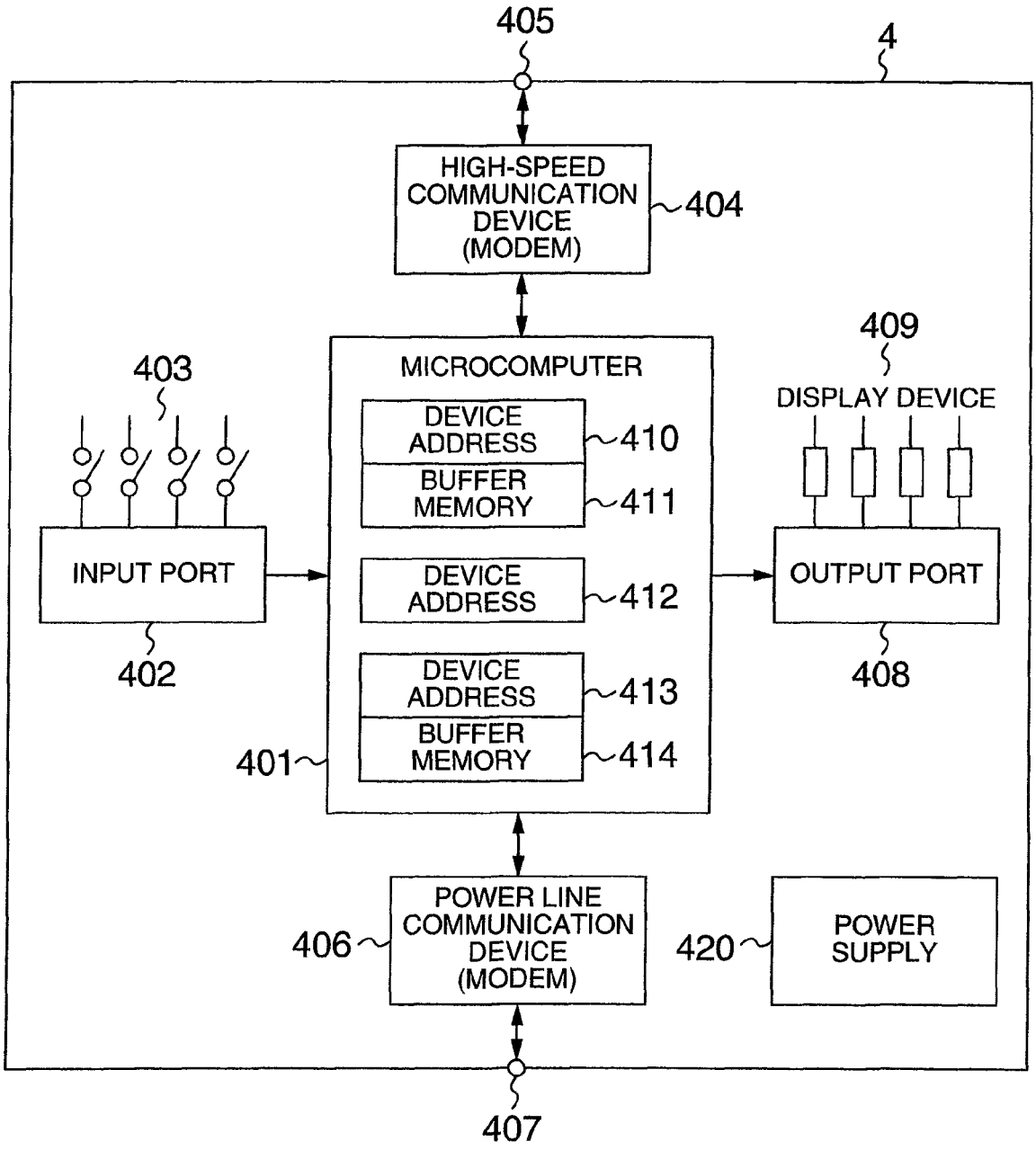
FIG. 6 is a schematic diagram showing an arrangement of a bridge included in the embodiment of the present invention.

FIG. 6 is a schematic diagram showing the internal arrangement of the bridge 4 included in the first embodiment of the present invention. The bridge 4 corresponds to one of the bridges 4*a* to 4*c* having described with reference to FIG. 1. The other bridges have the same arrangement. The bridge 4*a* includes a microcomputer 40*a* as a main component and further an input port 402, a setting switch 403, a high-speed communication device (modem) 404, its transmission terminal 405, a power line modem 406, its transmission terminal 407, an output port 408, a display device 409, and a power supply 420. The microcomputer 401 includes a memory for storing information of the setting switch 403 read through the input port 402, for example, the information of the unit itself such as the unit address and the refrigerant system information, memories 410 and 412 for storing a unit address of a destination terminal connected with the high-speed communication line and a unit address such as a buffered message, and memories 413 and 414 for storing a plurality of unit addresses and buffered message of destination units through the power line communication device (modem) 406. In the bridge 4, the corresponding address with the conventional net and the corresponding address with the power line communication are converted.

Further, in the bridge 4, only the data oriented to the indoor unit connected with the branch power line is passed from the leased communication line side to the branch power wire side. This results in reducing the number of data pieces on the branch power line. This makes it possible to keep the high-speed leased communication line and the slow branch power line coexistent in the same system.

The communicating connection of the microcomputer 401 is formed as follows. The microcomputer 401 starts from the high-speed communication device (modem) 404, passes through the terminal 405, the connecting wire 10 between the communication areas, and the leased transmission line 9, and then reaches another outdoor unit, the central controller 7, and the gateway 8. Further, the microcomputer 401 causes the power line communication device (modem) 406 to connect the indoor unit through the terminal 407 and the branch power line. Of course, this bridge is connected with another bridge 4 through the connecting wire 10 between the communication areas. However, the main object of the air conditioning system is to execute the communication in the same refrigerant system. Basically, therefore, the bridge is not required to communicate with another bridge for the purpose of control. In addition, since the communication is executed in the bus-connection arranged to use the same transmission medium, the access to the bus may be monitored because the access control is required.

Figure 7:
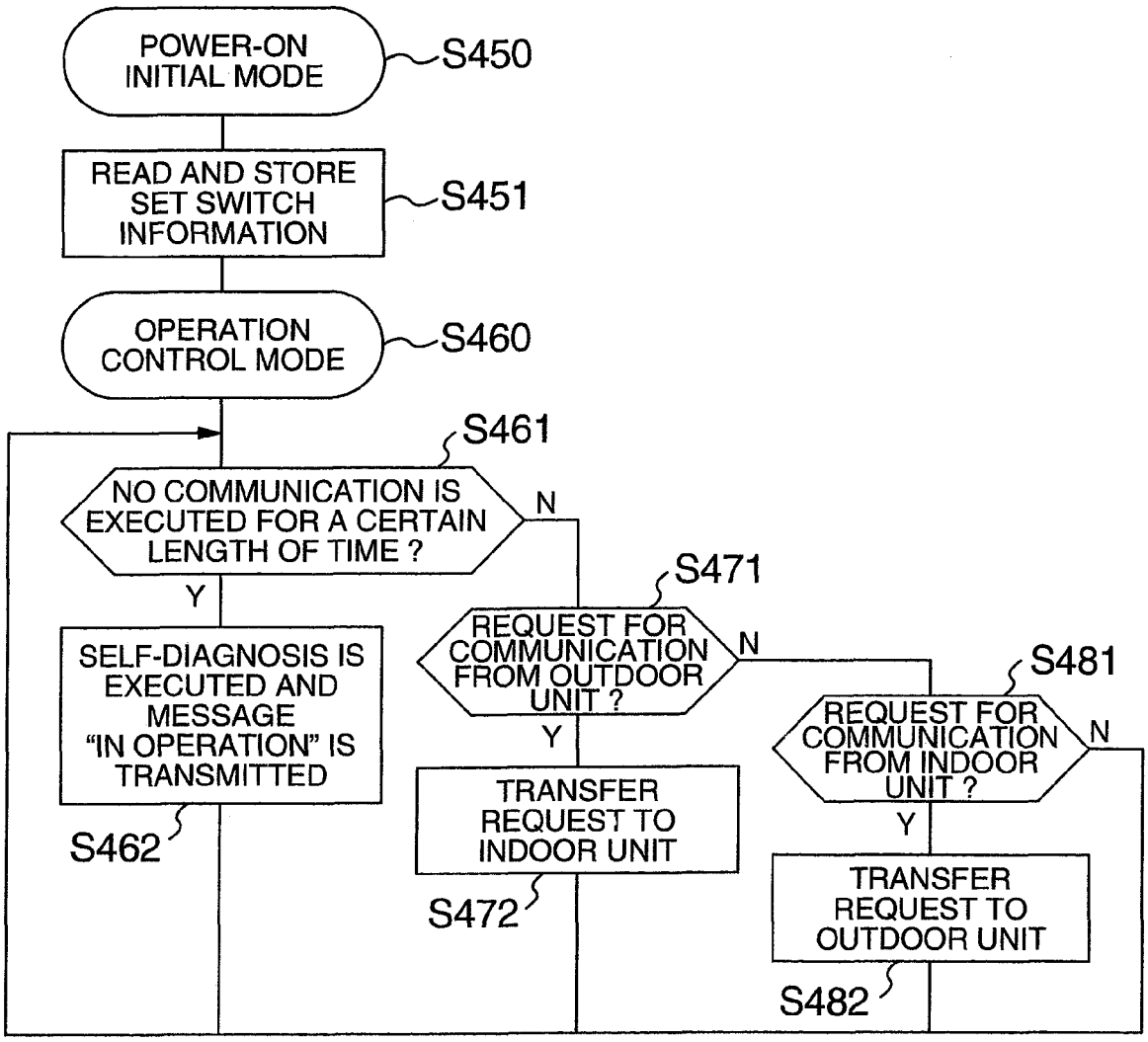
FIG. 7 is a flowchart showing an operation of the bridge included in the embodiment of the present invention.

FIG. 7 is a flowchart showing an operation sequence of the bridge included in the first embodiment of the present invention. The bridge has a function of communicating with the indoor unit and the central controller through the effect of the high-speed communication device (modem) or the indoor unit through the effect of the power line communication device (modem), converting the received communication information and the speed communication protocol, and re-transmitting the converted data. At a power-on initial mode (S450), if the power supply is turned on (S451), the microcomputer 401 operates to read the setting information (such as the refrigerant system and its own communication terminal address) of the setting switch 403 through the input port 402 and then store the setting information in the memory located inside the microcomputer itself (S451).

At an operation control mode (S460), when the indoor unit issues a request for communication (S471), the bridge transfers the received information to the indoor unit (S472). When the request for transmitting the information is sent to the bridge by the indoor unit (S481), the bridge transfers the received information to the outdoor unit (S482). If no communication is given for a certain length of time (S461), the bridge executes the self-diagnosis and then reports the result to the other connecting devices (S462). The main function of the bridge is to transfer the communication information. Hence, the bridge is required to register the communication terminal address of the destination. This registration is executed in the address inquiry included in the initial sequence of the central controller of the outdoor unit.

The features of the first embodiment of the present invention are as follows.

(1) The leased communication device (modem) is applied to the outdoor unit and the power line communication device (modem) is applied to the indoor unit. This allows the communication device to be assigned to the proper side.

(2) The location of the blocking filter in each branch power line makes it possible to divide the power line communication area.

(3) The connecting wire 10 between the communication areas is routed as the high-speed transmission lines through the bridges and then connected with the transmission line 9 of the outdoor installing area.

(4) The transmission system adopts a bus system in which a pair of wires are routed with lots of communication devices.

(5) In the air conditioning system, the indoor units are grouped at each setting area. From this feature, the installed indoor unit group coincides with the branch wire in topology. It means that the refrigerant piping forms the same topology as the branch power line.

As described above, the application of the power line communication device (modem) to the indoor unit side makes it possible to remove the transmission line on the indoor unit side. This results in reducing the installing steps of the indoor units by two-thirds, that is, the steps about the power line and the refrigerant piping. Since the refrigerant piping has the same topology as the power line, both of them may be installed at a time or along the preceding installation. This makes the attaching work easier.

In the conventional air conditioning system, the power line for the air conditioning system is used in common with for the other electric power load of the house builder, while the refrigerant piping and the transmission line both of which are leased to the air conditioners are installed together. This may bring about an overlap of the transmission lines installed from the outdoor unit installing area to the indoor unit installing area or causes an installing worker to be perplexed in selecting the transmission line. On the other hand, in this embodiment, just one connecting wire 10 between the communication areas is used. This makes the working plan more clear and economical.

Further, in the conventional air conditioning system, the transmission line takes a routing system, while the power line and the refrigerant piping are installed in common. Hence, the former and the latter are different from each other in wiring topology. In performing the renewal work of changing the indoor unit to a new one and modifying a part of the indoor unit, once the wires of the indoor units are disconnected, it is quite difficult to find the connecting terminals again. In actual, after all, the renewal of the conventional air conditioning system is revised. In this embodiment, since the power line communication is used, the power line and the refrigerant piping may be reused, which makes the renewal work more economical.

Further, since the use of the connecting wire 10 between the communication areas for the transmission line allows the branch lines to be routed, the transmission line among the indoor units may be removed. Further, though it has been difficult to reproduce the chain of the transmission line, the transmission line is routed to the bridges. This eliminates the necessity of the work about the indoor units in the renewal work, which leads to greatly saving the wiring work and thereby making the overall work more economical.

The conventional air conditioning system arranged to use the power line as transmitting means is restrictive in transmission speed and topology. For example, the practical transmission speed of the power line is about 5 kbps or less, which is about half as slow as the transmission speed of the conventional air conditioning system. It means that the use of the power line results in lowering the response, that is, the service. Further, the air conditioning system is arranged so that the outdoor unit is connected with the three-phase power line and the indoor unit is connected with the single-phase power line. These power lines are separated from each other from a viewpoint of the characteristics of the large electric power transformer. This thus needs a special connecting means, that is, a connection between the different phase power lines. In order to use the power line communication on the side of the outdoor unit in which a great electric power is consumed, the blocking filter with a large volume is required to be used, which disadvantageously leads to raising the overall cost.

In the general power line communication, a high-frequency signal is overlapped with the electric power passing through the power line where noises are often caused by the power supply or the on or off switching thereof when the signal is in transmission. Hence, this communication system is slower in transmission speed than the conventional communication device arranged to use the leased transmission line. In this example, it is made lower by one-fourth. The replacement of the conventional communication device with the power line communication device in a one-to-one manner disadvantageously causes the power line communication system to lower the operating response, that is, the service performance than the conventional system. In order to overcome this disadvantage, this embodiment is arranged to transmit the communication information of the indoor units to the outside units through the high-speed leased wires in a bridged manner. Hence, even though the communication speed of the branch wire is slow, the power line communication system enables to keep the service performance constant without having to lower the communication speed of the overall system.

Though the bridge and the blocking filter may be fitted in the distribution board, if the connecting wire 10 between the communication areas is routed together with the single-phase power line 15 between the distribution boards, the electric engineers are in charge of a part of the leased wire to the air conditioner. The location of the bridge between the distribution board and the first indoor unit to be connected with the power wire eliminates the necessity of routing the connecting wire 10 to the distribution board only if the connecting wire 10 is routed around together with the refrigerant piping by the same working method as the conventional work. This results in making the workability more excellent.

In turn, the description will be oriented to the second embodiment of the present invention with reference to FIGS. 8 to 11.

Figure 8:
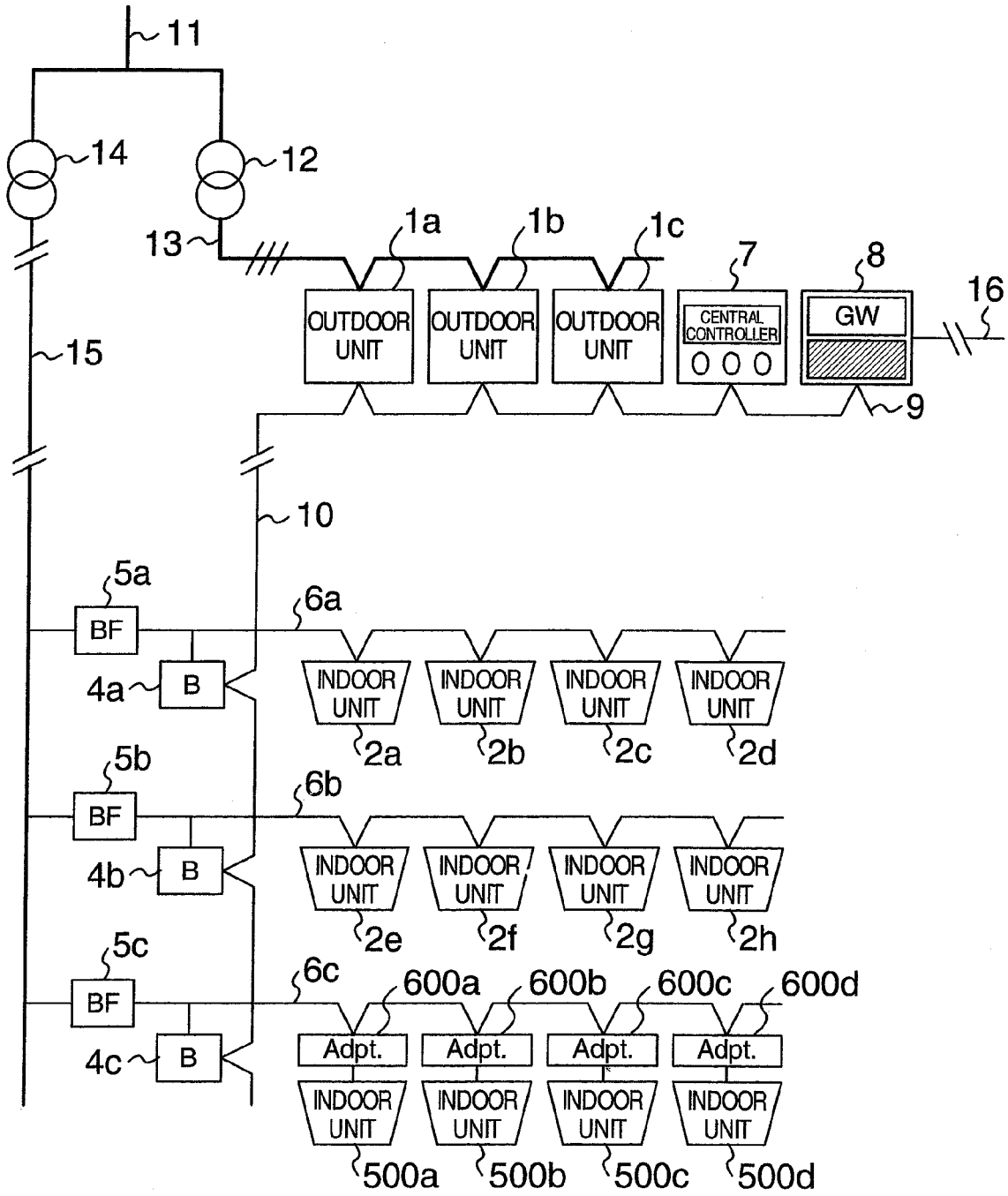
FIG. 8 is a schematic diagram showing an air conditioning system according to the other embodiment of the present invention.

FIG. 8 is a schematic diagram showing an arrangement of an air conditioning system according to the second embodiment of the present invention. The different respect of the second embodiment from the first embodiment is a connection of the indoor units 500*a* to 500*d* through adapters 600*a* to 600*d* in addition to the connection of the indoor units 2*a* to 2*h*. Like the first embodiment, the second embodiment is equipped with the refrigerant piping, though it is not shown in FIG. 8.

Each of the indoor units 500*a* to 500*d* has the same arrangement as the conventional indoor unit. The indoor unit supplies the transmission data and the electric power through the effect of the adapter 600.

Figure 9:
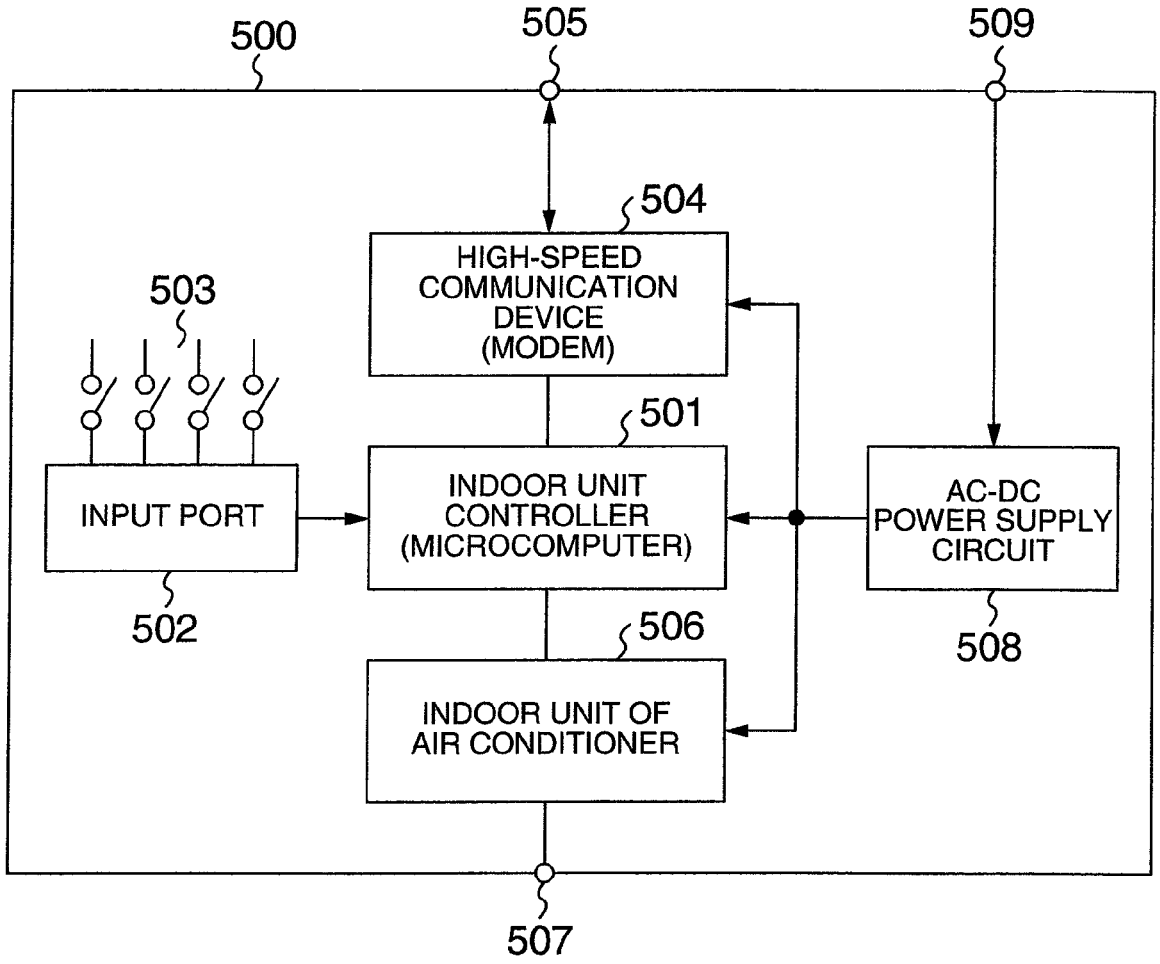
FIG. 9 is a schematic diagram showing an arrangement of the indoor unit included in the other embodiment of the present invention.

FIG. 9 is a schematic diagram showing an internal arrangement of the indoor unit 500 included in the second embodiment of the present invention. The indoor unit 500 corresponds to one of the indoor units 500*a* to 500*d* having been described with reference to FIG. 8. The other indoor units have the same arrangement. The indoor unit 500 includes an indoor controller 501 as a main component. Further, the indoor unit 500 includes an input port 502, a setting switch 503, an indoor unit body 506, and a power supply 508 located around the indoor unit controller 501. The difference of the indoor unit 500 from the indoor unit 2 having been described with respect to the first embodiment is that the communication device is the conventional high-speed communication device (modem) 504. It means that no impedance upper is provided and the communication terminal is the conventional terminal 507. The indoor unit 2 of the first embodiment uses the power line communication device 204 for removing the high-speed communication line terminal 505 of the indoor unit 500 and the transmission line between the indoor units following the indoor unit 500. The operation flow of the indoor unit 500 is the same as that of the indoor unit 2 except the lower order portion of the communication.

Figure 10:
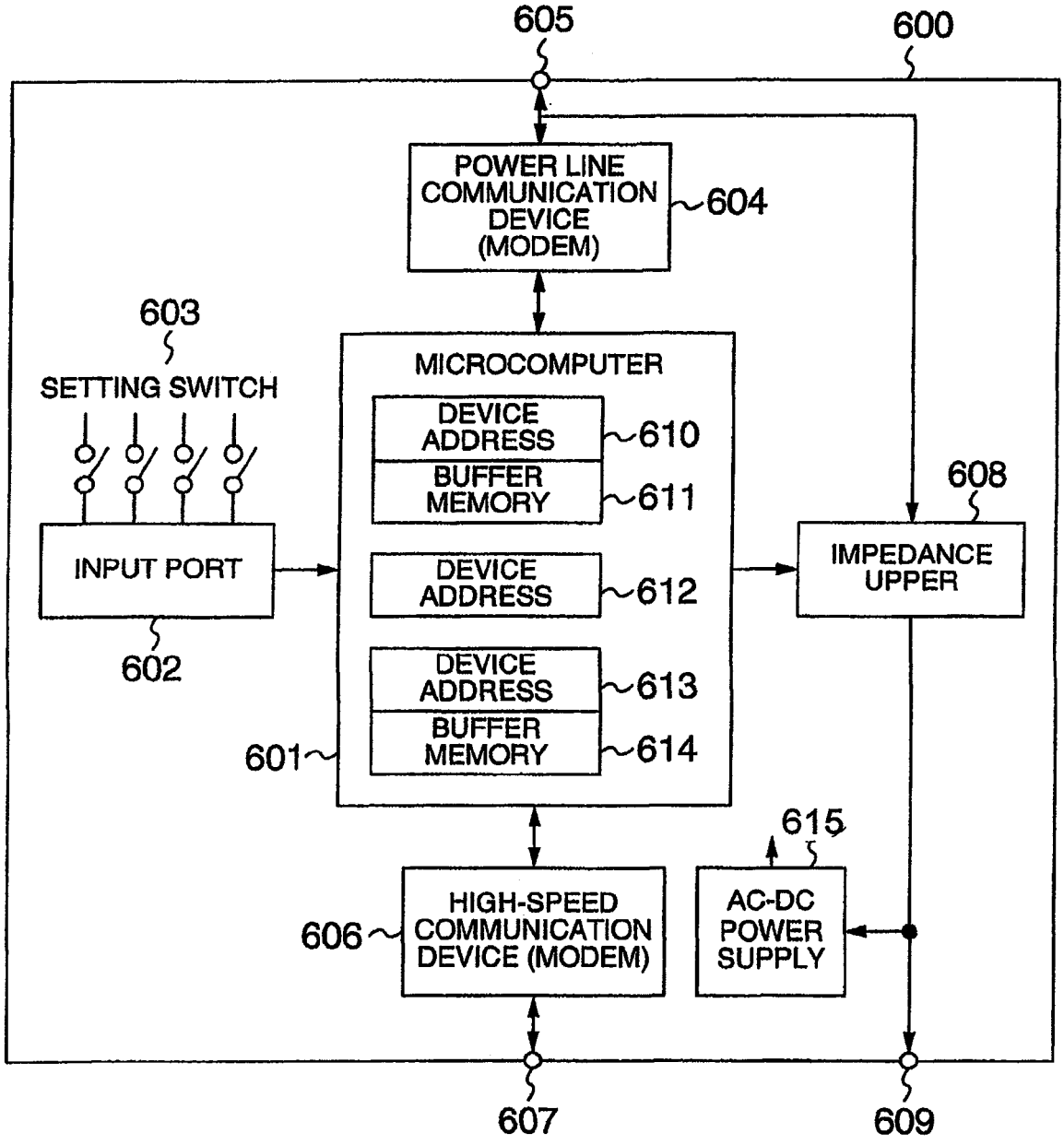
FIG. 10 is a schematic diagram showing an adapter included in the other embodiment of the present invention.

FIG. 10 is a schematic diagram showing the internal arrangement of the adapter 600. The adapter 600 corresponds to one of the adapters 600*a* to 600*d* having been described with reference to FIG. 8. The other adapters have the same arrangement. The adapter 600 includes a microcomputer 601 as a main component. Further, the adapter 601 includes an input port 602, a setting switch 603, a power line communication device (modem) 604, its transmission terminal 605, a high-speed communication device (modem) 606, its transmission terminal 607, an impedance upper 608, an indoor unit power supply terminal 609, and a power supply 610 located around the microcomputer 601. The microcomputer 601 has the substantially same internal arrangement as the bridge. However, since just one connecting device (indoor unit) is prepared, the memory is secured only for one terminal. Hence, the memory size is about one-tenth as small as that of the bridge. The adapter may be arranged as the hardware more economically than the bridge. The microcomputer includes the substantially same software as the bridge except the unit address and the software portion about a single communication buffer memory. The communication connection of the microcomputer 601 is the same as that of the bridge 4.

Figure 11:
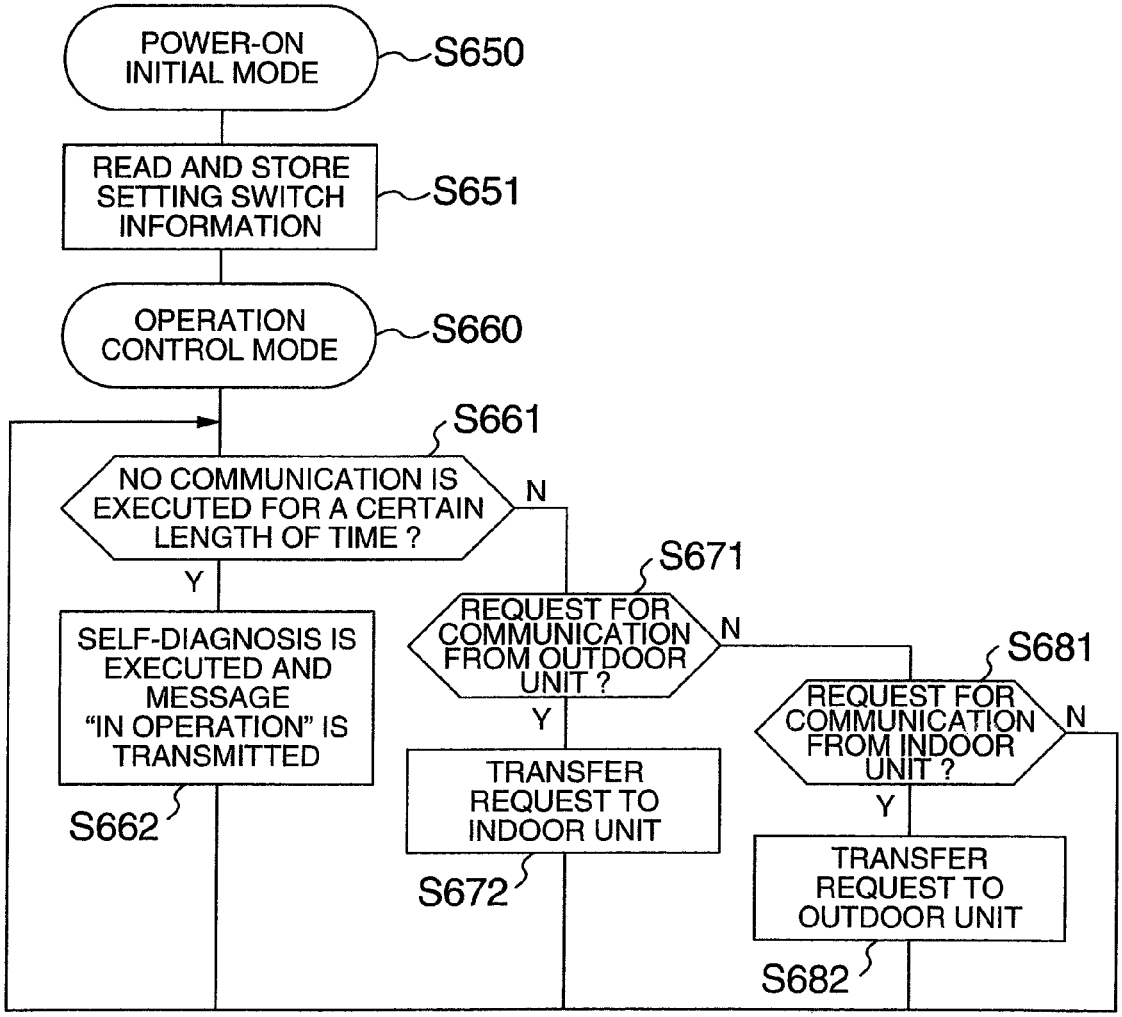
FIG. 11 is a flowchart showing an operation of the adapter included in the other embodiment of the present invention.

FIG. 11 is a flowchart showing an operation sequence of the adapter 600. The bridge operates to exchange the communication information between the communication terminal on the leased communication wire and the indoor unit on the branch power wire for which the bridge is responsible. This communication terminal stores the addresses of the terminal on the leased communication line and the indoor unit on the branch power line for which the terminal is responsible.

The feature of the second embodiment of the present invention is as follows.

The foregoing arrangement allows the conventional indoor unit to be built in the air conditioning system according to the present invention. That is, the manufactured or the existing indoor units may be used in the present air conditioning system. However, the various ways of use may be considered. For example, the indoor units intended for the air conditioning system of the present invention and the conventional indoor units may be mixedly built in the present air conditioning system when all the indoor units are newly installed in the building. Further, when installing the present air conditioning system in the building, some of the already installed indoor units are left and the conventional indoor units may be connected therewith through the adapter 600. Moreover, this adapter allows the indoor units of the air conditioning system of the present invention to be installed in the existing air conditioning system. That is, when updating the air conditioning system, it is not necessary to consider the complicated transmission wires among the indoor units, which brings about the effect of reducing the topology difference in the conventional three attaching work processes by two-thirds. In addition, the adapter allows the indoor unit 2 to be connected with the conventional system.

Further, the indoor units on the conventional transmission line may be connected to the power line communication system with the protocol converting unit added thereto. This may offer the same effect. Moreover, the indoor units on the power line communication system may be connected to the conventional transmission line with the protocol converting unit added thereto. This may offer the same effect.

According to this embodiment, the air conditioner arranged to use the transmission line for the data communication may be communicated with the air conditioner arranged to use the power line for the data communication. This makes it possible to install the air conditioner arranged to use the power line for the data communication when replacing only some air conditioners in the building where the air conditioning system arranged to use the transmission line for the data communication have been installed.

Further, the use of a slow power line communication device also makes it possible to realize the substantially same communication throughput as the conventional system. This enables to save the necessary wires without having to lower the service.

Moreover, provision of a network ID indicator in each bridge and each outdoor unit makes it easier to perform the refrigerant system settings. (The settings may be reduced in the setting of bridge location=indoor unit location).

The central controller and the WAN-connecting GW device, which have been conventionally used in the air conditioning system, may be connected with the high-speed communication path. This is effective in keeping the same service level as the conventional air conditioning system.

According to the present invention, the air conditioning system may be arranged to use the power line for the data communication and thereby saves the necessary resources and installing work.

It should be further understood by those skilled in the art that although the foregoing description has been made on embodiments of the invention, the invention is not limited thereto and various changes and modifications may be made without departing from the spirit of the invention and the scope of the appended claims.

What is claimed is:

1. An air conditioning system having a plurality of indoor units, at least one outdoor unit, and a system controller for controlling said indoor units or outdoor unit, said system comprising:

a leased communication line for connecting said at least one outdoor unit with said system controller;

a leased communication means provided in said at least one outdoor unit and being connected with said leased communication line;

a first power line supplying electric power for said at least one outdoor unit;

second power lines supplying electric power for said indoor units;

power line communication means provided in each of said indoor units and being connected with said second power lines; and bridges for connecting said leased communication line with said second power lines; wherein said indoor units are divided into plural groups in every one or more indoor units, said indoor units in the same group share the same second power line, said second power line is branched for each group having a blocking filter, and control information is exchanged mutually among said indoor units, said at least one outdoor unit and said system controller.

2. An air conditioning system as claimed in claim 1, wherein said blocking filter is arranged to avoid transmission of control information among said second power lines belonging to different indoor unit groups.

3. An air conditioning system as claimed in claim 1, wherein said bridges are arranged one-by-one in said every indoor unit group, and each bridge transmits control information to said indoor units in one's own group via said second power line, only if said control information from said at least one outdoor unit or said system controller involves the address of one's own group.

4. An air conditioning system as claimed in claim 1, wherein said second power lines are arranged to supply electric power to said indoor units through single-phase power lines, and said first power line is arranged to supply electric power to said at least one outdoor unit through a three-phase power line.

5. An air conditioning system as claimed in claim 1, wherein each of some indoor units in said indoor units have an impedance upper at an input side of the power line for an ac-dc converter involved in each of said some indoor units.

6. An air conditioning system having a plurality of indoor units, at least one outdoor unit, and a system controller for controlling said indoor units or outdoor unit, comprising:

a leased communication line for connecting said at least one outdoor unit with said system controller;

leased communication means provided in said outdoor unit and being connected with said leased communication line;

first power line supplying electric power for said at least one outdoor unit;

second power lines supplying electric power for said indoor units;

power line communication means provided in each of said indoor units and being connected with said second power lines;

bridges for connecting said leased communication line with said second power lines; wherein said indoor units divided into plural groups in every several units, said indoor units in the same group share the same second power line, said second power line in each group has a blocking, and control information is exchanged mutually between said at least one outdoor unit and said bridges via said leased communication line, and between said bridges and said indoor units via said second power lines.

7. An air conditioning system as claimed in claim 6, wherein said blocking filter is arranged to avoid transmission of control information among said second power lines belonging to different indoor unit groups.

8. An air conditioning system as claimed in claim 6, wherein said bridges are arranged one-by-one in said every indoor unit group, and each bridge transmits control information to said indoor units in one's own group via said second power line, only if said control information from said at least one outdoor unit or said system controller involves an address of one's own group.

9. An air conditioning system as claimed in claim 6, wherein said second power lines are arranged to supply electric power to said indoor units through single-phase power lines, and said first power line is arranged to supply electric power to said at least one outdoor unit through a three-phase power line.

10. An air conditioning system as claimed in claim 6, wherein each of some indoor units in said indoor units have an impedance upper at an input side of the power line for an ac-dc converter involved in each of said some indoor units.

* * * * *